US005488383A

United States Patent [19]

Friedman et al.

[11] Patent Number: 5,488,383

[45] Date of Patent: Jan. 30, 1996

[54] METHOD FOR ACCURIZING MESH FABRIC REFLECTOR PANELS OF A DEPLOYABLE REFLECTOR

[75] Inventors: Arnold Friedman, Redwood City; William Ribble, San Jose; William D. Wade, Los Gatos, all of Calif.

[73] Assignee: Lockheed Missiles & Space Co., Inc., Sunnyvale, Calif.

[21] Appl. No.: 181,747

[22] Filed: Jan. 21, 1994

[51] Int. Cl.[6] ..... H01Q 15/14

[52] U.S. Cl. ..... 343/912; 343/897; 343/915; 112/475.08; 29/600

[58] Field of Search ..... 343/897, 912, 343/915, 840, 873; 112/153, 262.1, 265.1; 135/33.4, 33.5, 33.6; 29/600; H01Q 15/14, 15/20

[56] References Cited

U.S. PATENT DOCUMENTS

| | | | |
|---|---|---|---|
| 3,235,872 | 3/1963 | Schepis | 343/912 |
| 3,541,569 | 11/1970 | Berks et al. | 343/915 |
| 3,998,173 | 12/1976 | Wiliamson et al. | 343/897 |
| 4,030,103 | 6/1977 | Campbell | 343/915 |
| 4,115,784 | 9/1978 | Schwerdtfeger | 343/915 |
| 4,608,571 | 8/1986 | Luly | 343/781 |
| 4,647,943 | 3/1987 | Metcalfe | 343/916 |
| 4,769,647 | 9/1988 | Herbig et al. | 343/915 |
| 4,811,033 | 3/1989 | Ahl et al. | 343/880 |
| 4,899,167 | 2/1990 | Westphal | 343/915 |
| 5,198,832 | 3/1993 | Higgins et al. | 343/915 |

*Primary Examiner*—Donald T. Hajec
*Assistant Examiner*—Tan Ho
*Attorney, Agent, or Firm*—Feix & Feix; H. Donald Volk

[57] ABSTRACT

A method for sewing a plurality of gore-shaped metalized mesh fabric panels to each other to form a parabolic dish-shaped reflector surface for subsequent attachment to the radially extendable rib members of a deployable parabolic reflector. The method includes using a template having "cut" and "sew" lines indicated thereon for cutting out a desired number of gore-shaped panels from a bolt of metalized mesh fabric and sewing the panels together along adjacent side edges thereof to form the dish-shaped reflector surface. The dish-shaped reflector surface is then attached to the reflector by sewing the mesh fabric panels to stitch holes provided in each rib member. The reflector surface is accurized by using a wedge-shaped tool which is placed on a slack reflector panel adjacent a gore seam. A cord is then laced thereover along its length, after which the tool is removed, and the two ends of the cord are pulled tight thereby forming a tuck seam in the reflector panel which takes up slack in the reflector surface. A novel metalized mesh fabric construction is also disclosed and includes silver coated nylon strands and denier dacron strands interwoven in a "Marquisette" or "Leno" style weave. The weave has openings sized sufficiently large to minimizing the effects of wind load yet sufficiently small to provide good reflective performance of radio frequencies up to and including X-Band frequencies.

6 Claims, 7 Drawing Sheets

FIG_3
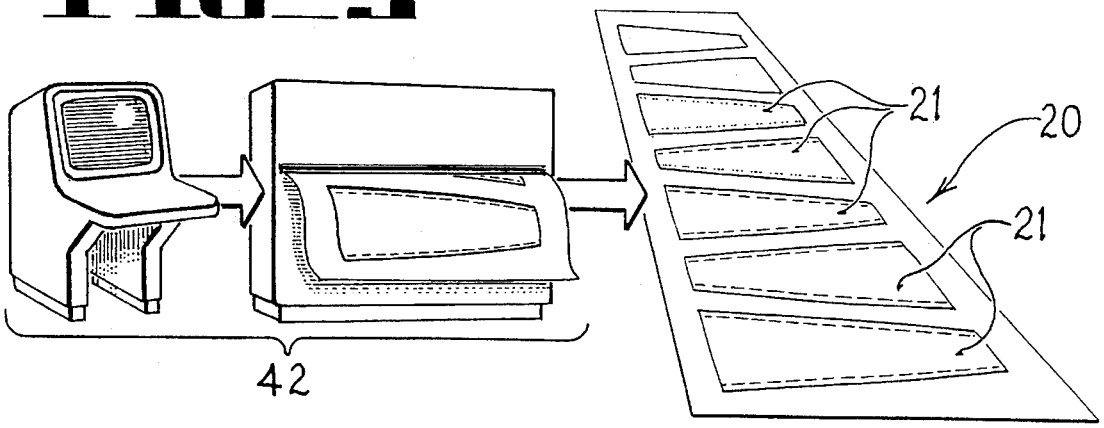
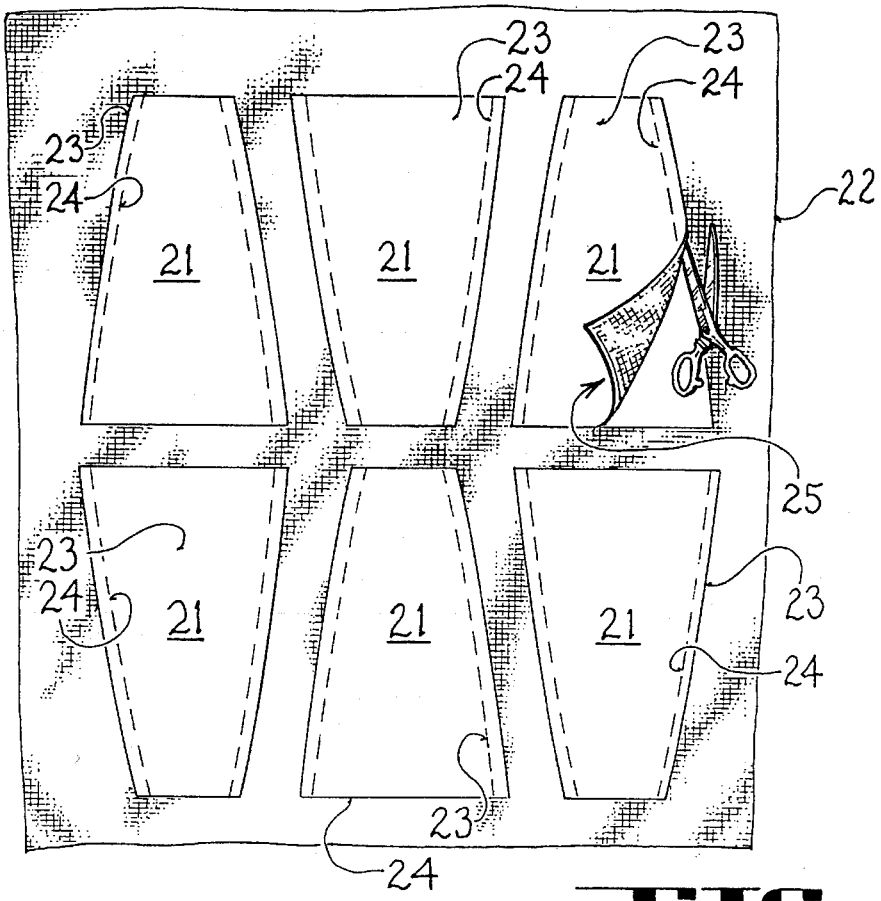
FIG_4

FIG_7A
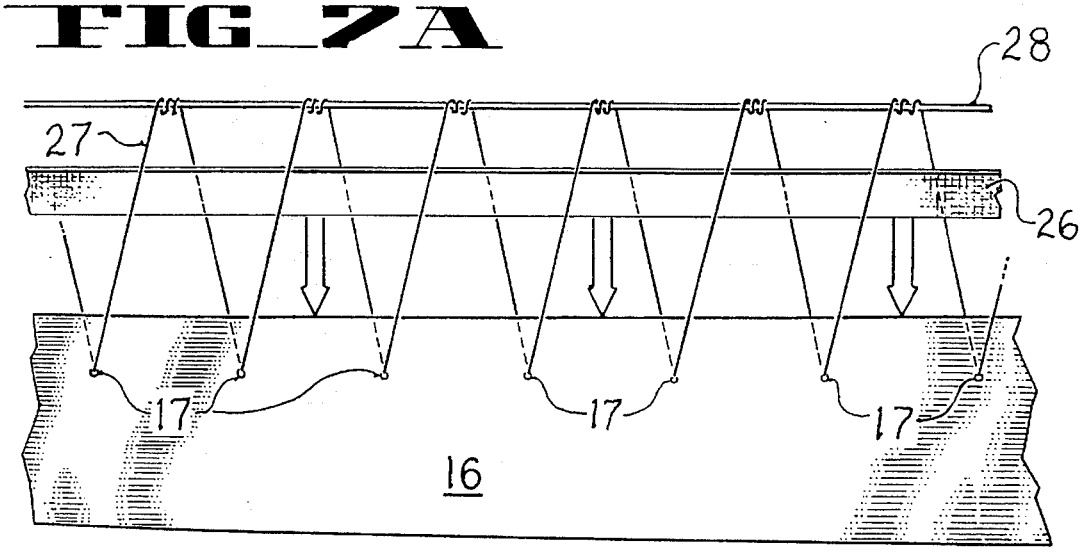
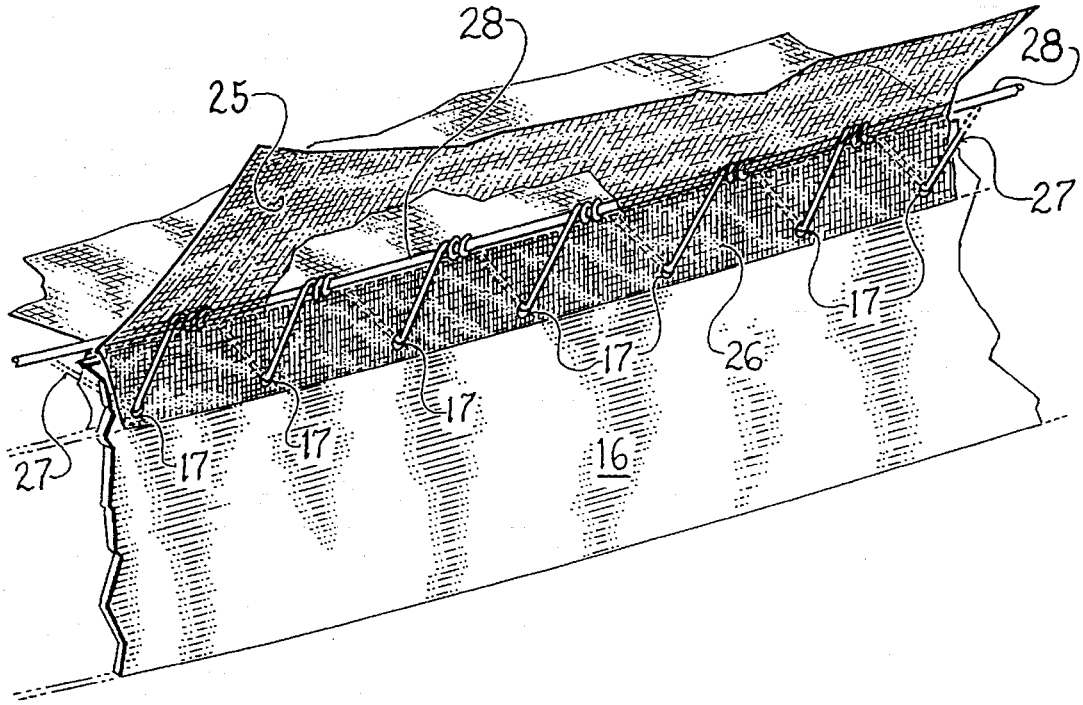
FIG_7B

FIG_9A
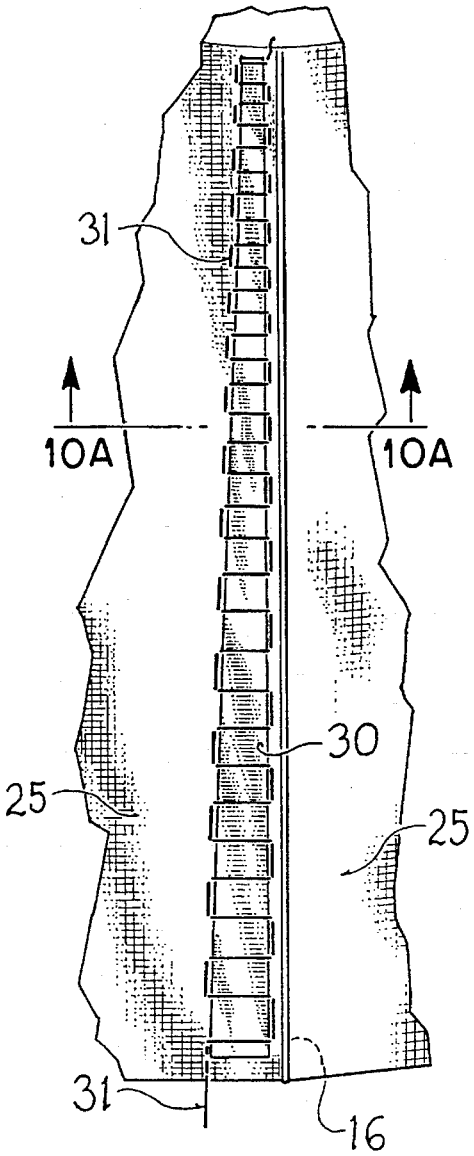
FIG_9B
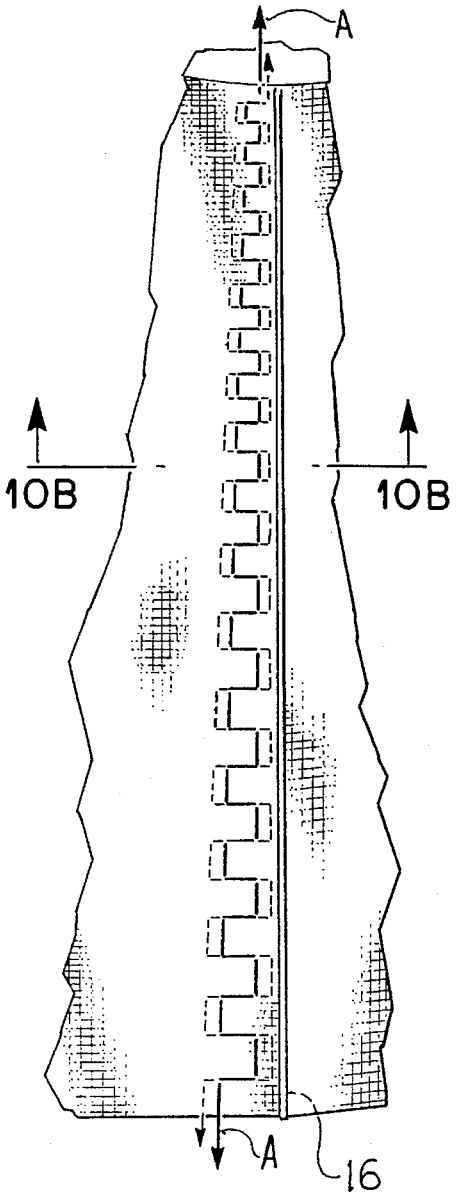
FIG_10A
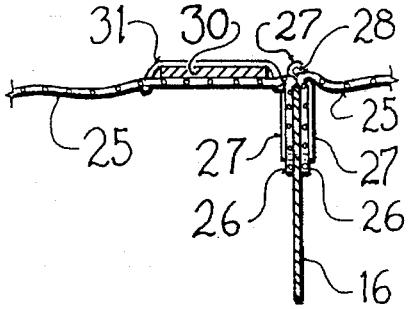
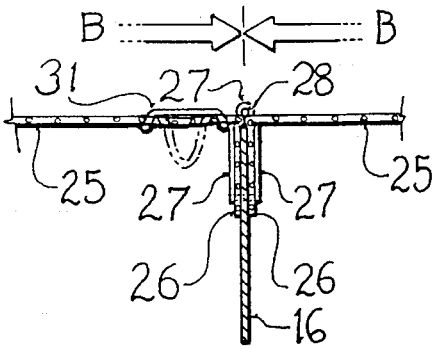
FIG_10B

FIG_11
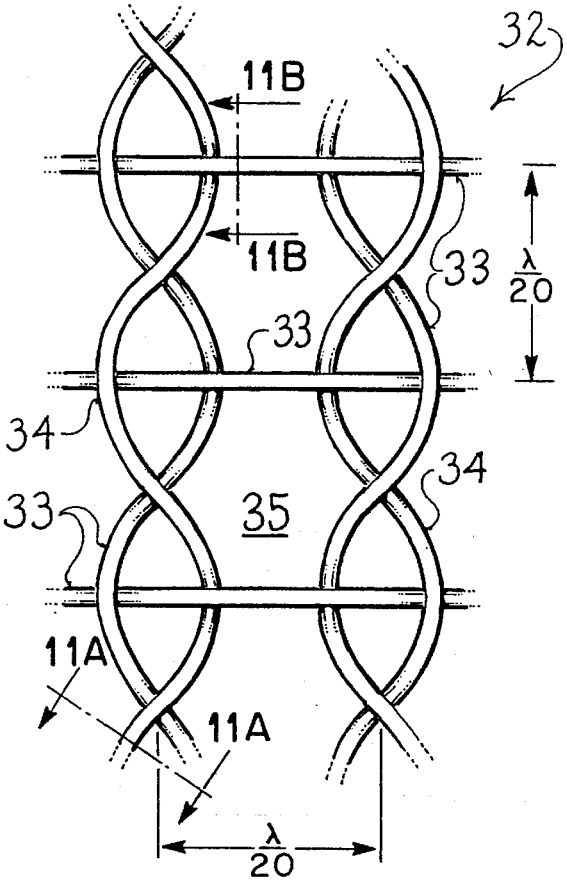
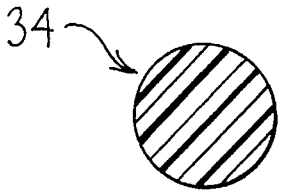
FIG_11B
FIG_11A
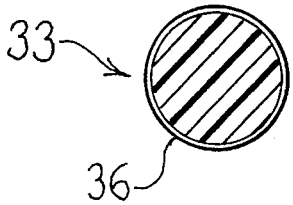
FIG_12A
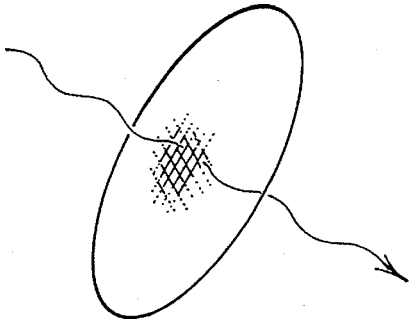
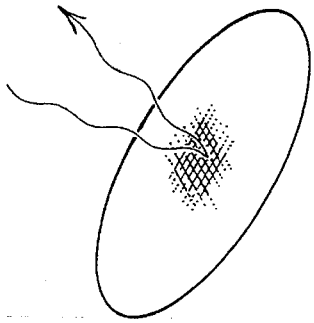
FIG_13A
FIG_13B
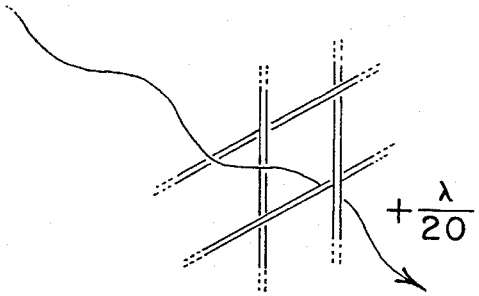
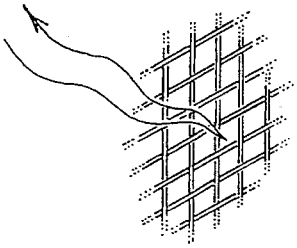
FIG_12B

METHOD FOR ACCURIZING MESH FABRIC REFLECTOR PANELS OF A DEPLOYABLE REFLECTOR

CROSS REFERENCES TO RELATED U.S. APPLICATIONS

The co-pending application Ser. No. 08/184,243, filed Jan. 19, 1994 and entitled "Redeployable Furlable Rib Reflector", Matthew Phillip Casebolt and William D. Wade inventors, is incorporated by reference in this application.

The co-pending application Ser. No. 08/184,465, filed Jan. 19, 1994 and entitled "Bearing Keeper Assembly for a Redeployable Furlable Rib Reflector", Matthew Phillip Casebolt inventor, is also incorporated by reference in this application.

BACKGROUND OF THE INVENTION

1. Field of the Invention

The present invention relates generally to deployable reflectors typically used in conjunction with mobile and portable ground station communication applications of the kind which include a hub, a plurality of rib members radially extendable therefrom and a metalized mesh fabric that stretches between and attaches to the rib members to form a dish-shaped reflective surface when the reflector is deployed. More particularly, the present invention relates to a novel metalized mesh fabric panel construction and method for attaching and accurizing the mesh fabric reflector panels onto the rib members of a deployable reflector.

2. Description of the Prior Art

Deployable reflectors for use in conjunction with radio frequency antenna assemblies for ground station communication applications are well known in the art. In accordance with typical prior art designs, such deployable reflectors include a foldable parabolic dish-shaped reflector surface consisting of a lightweight, flexible metalized mesh fabric which is stretched across and attached to a plurality of rib members that extend radially from a central support hub. Typically, the foldable reflector surface is constructed from a plurality of gore-shaped metalized mesh fabric panels which must be attached to each other and to the rib members in order to approximate the necessary parabolic curvature for the dish-shaped reflector surface.

One known approach to constructing a parabolic reflector surface from gore-shaped mesh fabric panels requires a specially made tool for building up the gore-shaped mesh fabric reflector panels to the desired bowl shape.

FIG. 2 shows an example of such a prior art tool 1 in the form of a plug mold having the desired reflector shape. The tool 1 includes a number of gore-shaped metal panels 2 positioned over a plurality of curved radial ribs 3 to form a dome representing the reflector surface. Gore-shaped mesh fabric panels 4 are then laid on the metal panels 2 and are held in place by magnets 5. The gore-shaped mesh fabric panels 4 are so positioned on the tool 1 such that their adjacent long side edges overlap one another by about ¾ of an inch (1.9 cm). The overlapping edges are then bonded together using a silicon adhesive to form a seam. Once the glue sets, a spatula or like tool is used to separate the glued seams from the metal gore-shaped panels 2 of the tool 1. Then, a second assembly operation is required for attaching the built up dish-shaped reflector surface to the individual, radially extended rib members of the reflector.

This is a long, tedious and messy operation which requires some skill to ensure accurate results. If the dish shape is wrong or there is too much slack in any particular panel region, the whole mesh fabric reflector surface is usually scrapped since it is too difficult to accurize or correct the shape of the mesh fabric panels once the glue sets.

A further disadvantage is that the tool itself is heavy, difficult to move, expensive and time consuming to construct and takes up a lot up floor space when not being used. Further still, a separate tool is required for each reflector size.

Accordingly, there is a definite need in the art for a low cost and simple method for accurately attaching a foldable reflector surface to the radial rib members of a reflector which is built up from a plurality of gore-shape metalized mesh fabric panels.

A further requirement of a foldable and deployable, metalized mesh fabric reflector surface is that it exhibit both excellent mechanical and electrical properties. In particular, the metalized mesh fabric should resist stretching or sagging as this will adversely affect the focusing accuracy of the reflector. Also, the "openings" in the weave for the metalized mesh fabric should be optimized to accommodate both mechanical and electrical requirements. That is, the weave openings should be large enough to minimize wind loads likely to be experienced during outdoor use and, at the same time, be sized sufficiently small to accurately reflect high radio frequency (RF) signals up to and including X-Band frequencies for satellite communications applications.

SUMMARY OF THE INVENTION

List of Objects

It is a primary object of the present invention to overcome the problems presented by the special tools and methods of the prior art for constructing and attaching a flexible metalized mesh fabric reflector surface to a deployable reflector.

Methods and apparatus which incorporate the desired features described above and which are effective to function as described above constitute specific objects of this invention.

It is another object of the present invention to provide an improved construction for a metalized flexible mesh fabric reflector material which exhibits excellent mechanical and electrical properties.

In accordance with the present invention, a preferred embodiment discloses a method for attaching by sewing a plurality of gore-shaped metalized mesh fabric panels to each other to form a parabolic dish-shaped reflector surface for subsequent attachment to the radially extendable rib members of a deployable parabolic reflector. The attachment method includes using a template having "cut" and "sew" lines indicated thereon for cutting out a desired number of gore-shaped panels from a bolt of metalized mesh fabric and sewing the panels together along adjacent side edges thereof to form the dish-shaped reflector surface. Next, the dish-shaped reflector surface is attached to the reflector by sewing the mesh fabric panels to stitch holes provided along the length of each rib member. The sewn attachment of the mesh fabric panels to the rib members preferably includes using a strand of monofilament or like material to help distribute the loads between stitch locations.

Also disclosed is a method for accurizing the reflector surface once the gore-shaped mesh fabric panels have been sewn to the rib members. The accurizing method includes placing a wedge-shaped tool, preferably formed from a Mylar sheet of about 0.5 mm thickness, on a slack reflector panel adjacent a gore seam and lacing a cord thereover and along the length thereof. The tool is then removed and the two ends of the cord are pulled tight thereby forming a tuck seam in the reflector panel which takes up slack in the reflector surface. An additional tuck seam may be necessary depending upon the amount of slack in the reflector surface.

Finally, a novel metalized mesh fabric construction is disclosed which includes silver coated nylon strands and denier dacron strands interwoven in a "Marquisette" or "Leno" style weave. The weave has openings sized sufficiently large to minimizing the effects of wind load yet sufficiently small to provide good reflective performance of radio frequencies up to and including X-Band frequencies.

List of Advantages

An important advantage of the present invention is that the sewing method of attachment of the gore-shaped mesh fabric reflector panels to each other and to the rib members is simple and inexpensive and permits for easy correction if the panels are improperly aligned in the first instance.

Another advantage of the present invention is that the sewing operations can be done using any sewing machine of reasonable quality.

Another advantage of the present invention is that in view of the simple accurizing procedure, the care and accuracy with which the reflector surface is initially installed can be relaxed.

Another advantage of the present invention is that the accurizing of the reflector surface using the described method is inexpensive and does not require highly skilled labor to implement.

Still another advantage of the present invention is that the novel mesh fabric construction provides a desired level of performance without a major redesign of existing mesh fabric constructions and utilizes commercially available low cost materials.

Other and further objects and advantages of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWINGS

The invention will be better understood by reference to the following detailed written description and to the drawings in which:

FIG. 3 is a flow diagram embodied in a series of three perspective views illustrating the steps for generating paper templates used as an aid for cutting and sewing the mesh fabric gore-shaped panels.

FIG. 4 is a plan view of a bolt of mesh fabric showing six gore-shaped paper templates pinned thereto. Each template has lines which indicate cut lines (solid lines) and sew lines (dashed lines).

FIGS. 7A–B are enlarged fragmentary perspective views showing how the mesh fabric reflector panels are attached by stitches to a radial rib member of a reflector. Also shown is a monofilament strand used for transferring loads between stitch locations to help hold the mesh fabric reflector panels to the rib members.

FIGS. 9A–9B is a series of enlarged fragmentary plan views showing a mesh fabric reflector panel before (FIG. 9A) and after (FIG. 9B) the accurization procedure.

FIG. 10A is a cross section view taken along the line and in the direction of arrows 10A—10A of FIG. 9A.

FIG. 10B is a cross section view taken along the line and in the direction of arrows 10B—10B of FIG. 9B.

FIG. 11 is a close up view of the weave for the mesh fabric reflector panel material of the present invention.

FIG. 11A is a cross section view taken along the line and in the direction of arrows 11A—11A of FIG. 10A.

FIG. 11B is a cross section view taken along the line and in the direction of arrows 11B—11B of FIG. 10B.

FIGS. 12A–13B are a series of schematic views of the fabric weave which illustrate how the performance characteristics of the reflector surface is dependent upon the wave length of the signal and the "openness" of the weave.

DESCRIPTION OF THE PREFERRED EMBODIMENT

Figure 1:
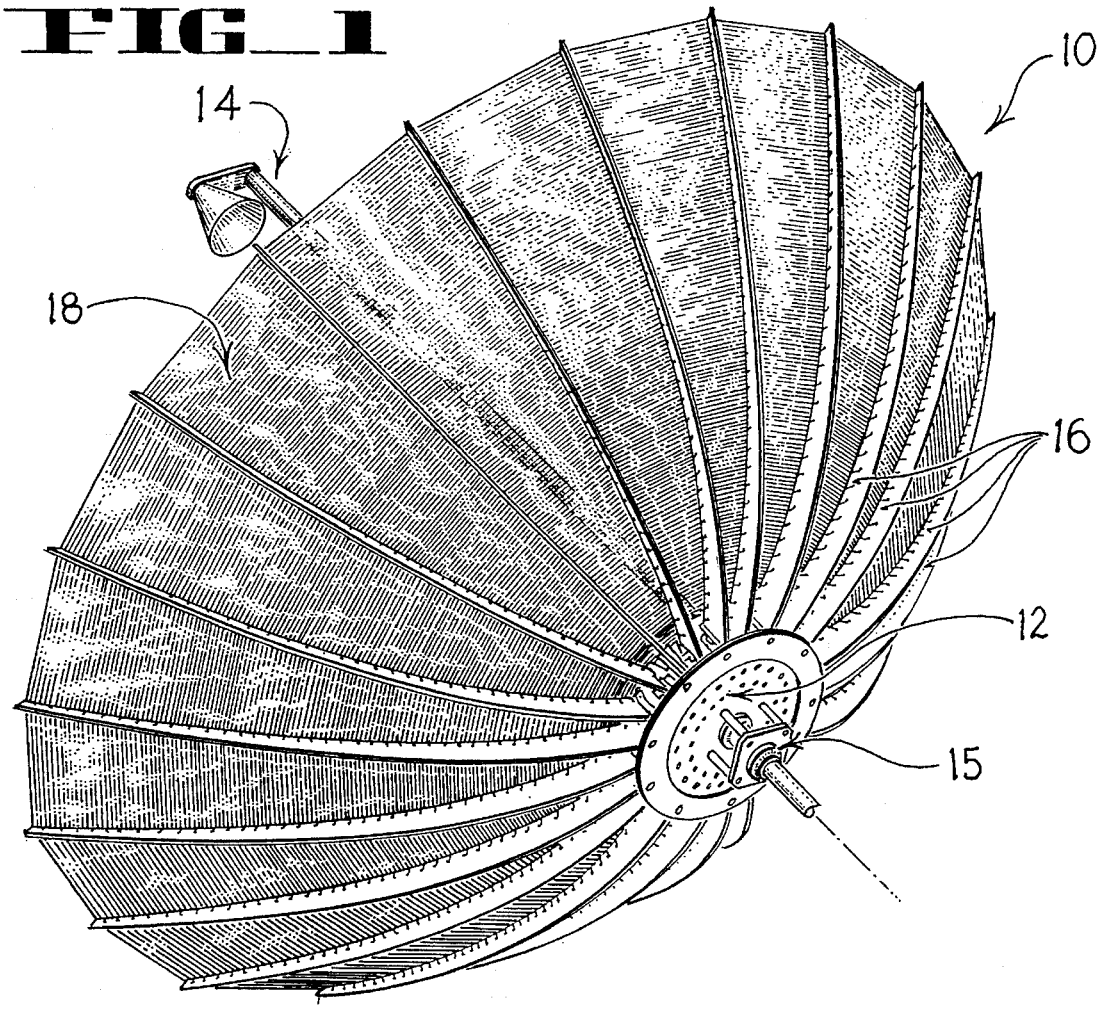
FIG. 1 is a perspective view of a deployable reflector in the deployed position showing individual metalized mesh fabric reflector panels attached to a plurality of rib members which extend radially from a central hub assembly.
Figure 2:
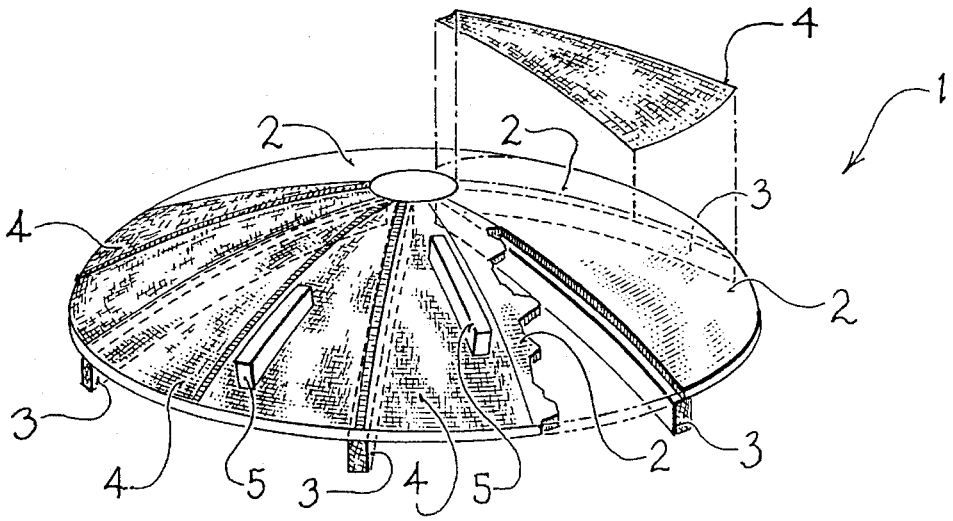
FIG 2 PRIOR ART
FIG. 2 is a perspective view illustrating a prior art tool 1 and method of use for constructing a parabolic dish-shaped reflector surface from a plurality of gore-shaped mesh fabric reflector panels 4.

A redeployable furlable rib reflector constructed in accordance with one embodiment of the present invention is indicated generally by reference numeral 10 in FIG. 1.

The reflector 10 in FIG. 1 is shown in the deployed position and includes a central hub assembly 12 on which an antenna feed assembly 14 is mounted and which, in turn, is mountable to a fixed support (not shown) by a standoff assembly 20. The reflector 10 further includes a plurality of radially extendable rib members 16 spaced about and pivotally attached to the hub assembly 12. In the deployed position shown, the rib members 16 form a parabolic dish shape. A light weight metalized mesh 18 is stretched across and secured to the rib members 16 to form the dish-shaped reflective surface.

FIG. 3 shows, in flow diagram format, the steps for quickly and accurately generating a sheet of gore-shaped paper templates 21 using a computer drawing system 22. The size of the gore-shaped paper templates 21 is selected to correspond to the size of the reflector panels. Each template 21 represents an individual segment of a solid revolution.

FIG. 4 illustrates the first cutting step of the method of the present invention. The equal gore-shaped paper templates are secured, preferably by pins (not shown), to a bolt of metalized mesh fabric material 22. Each template 21 has a "cut" line 23 (solid line) and a "sew" line 24 (dashed line) indicated thereon. Cutting the fabric 22 along cut lines 23 produces the individual gore-shaped mesh fabric reflector panels 25. Note that for the parabolic dish-shaped reflector 10 shown in FIG. 1, twenty gore-shaped panels are required to complete the parabolic reflector surface.

An alternative to using paper templates would be to silk screen a gore pattern with "cut" and "sew" line indicators directly onto the bolt of mesh fabric.

Figure 5A:
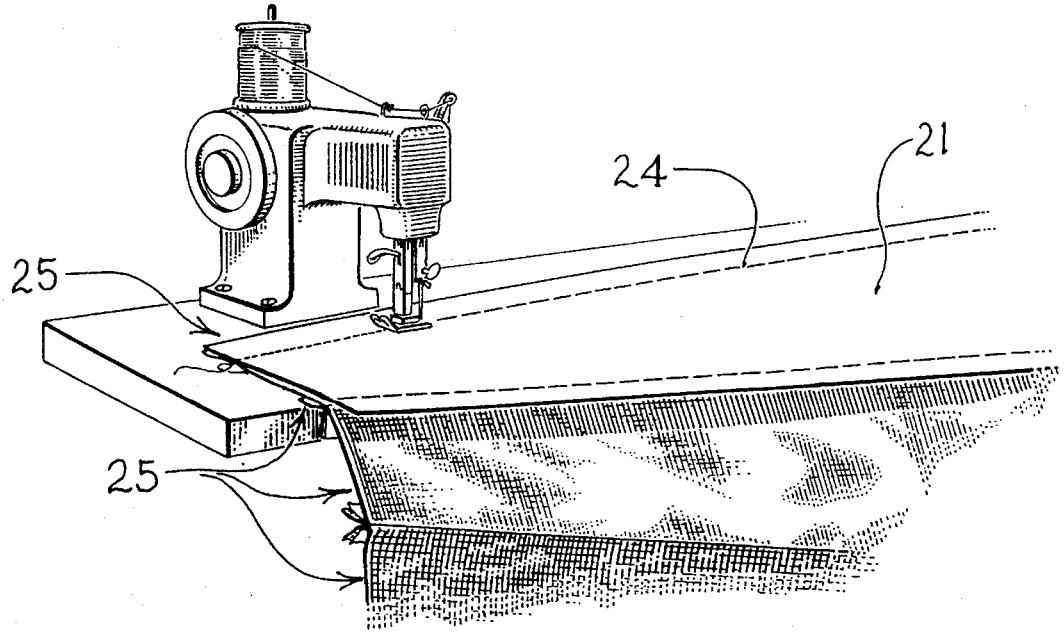
FIGS. 5A–5C are a series of perspective views which illustrate the sewing steps for joining adjacent long side edges of successive mesh fabric reflector panels.
Figure 5B:
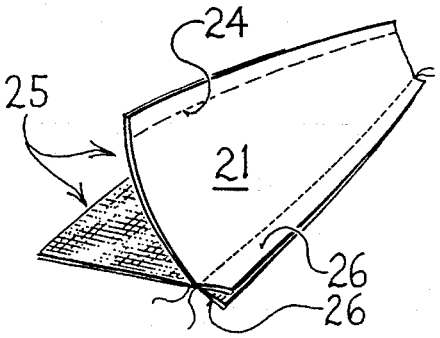
Figure 5C:
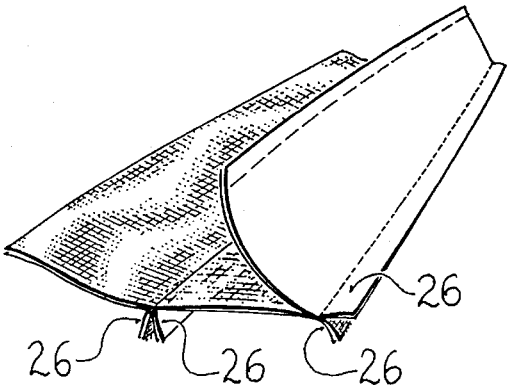

FIGS. 5A–5C illustrate the initial sewing steps of the method of the present invention. As seen in FIGS. 5A–5B, adjacent mesh fabric reflector panels 25 (with templates 21 still attached) are laid one on top of the other and are sewn together along one edge using the sew line 24 of the exposed paper template 25 as a guide, thereby creating flaps 26. The sew lines 24 are curved slightly to conform to the parabolic curvature of the rib member 16 (see FIG. 1). To attach a third mesh fabric reflector panel 25, the first two panels are unfolded and the third panel is laid on top of the second (or first) panel, paper side up, and is sewn along sew line 24 to the remaining free long side edge of the second (or first) panel 25 (see FIG. 5C). This sewing and folding/unfolding procedure is repeated for attaching the remaining panels 25, after which the last panel is attached to the original panel.

Figure 6:
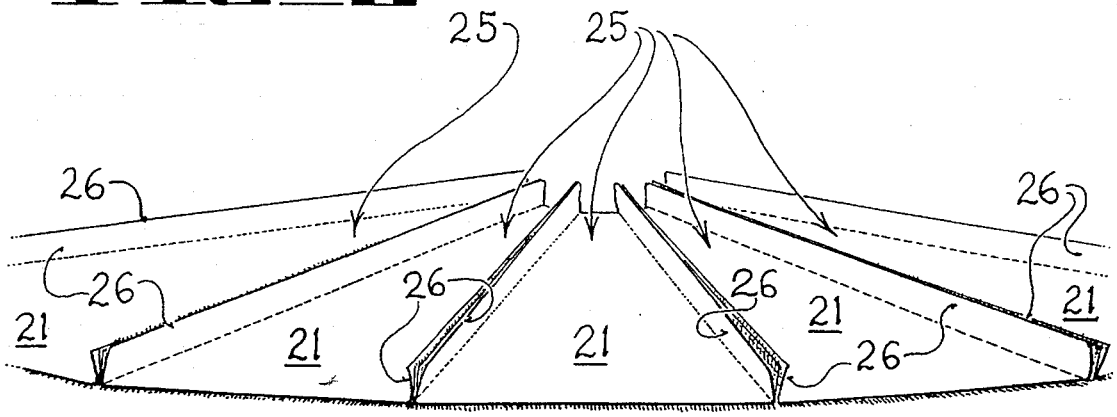
FIG. 6 is a perspective view of the reflector panels after they have been sewn together to form a parabolic dish-shaped reflector surface.

As seen in FIG. 6, the gore-shaped panels 25 will assume a bowl shape when fully sewn together. The paper templates 21 may now be removed from the mesh fabric panels 25 as they are no longer needed.

FIGS. 7A–B are similar enlarged fragmentary perspective views showing how the mesh fabric reflector panels 25 are attached by stitches to a radial rib member 16 of a reflector 25. In the preferred embodiment, the flaps 26 straddle the rib member 16 as shown in FIG. 7B and a thread 27 is sewn over the fabric and looped through a plurality of holes 17 in the rib member 16. The thread 27 is then pulled tight thereby drawing the fabric down onto the rib member 16 as shown by the arrows in FIG. 7A.

A more even distribution of the loads between the stitches can be achieved by first placing a single monofilament strand 28 on top the mesh fabric over the rib member 16 prior to stitching and looping the thread 1–3 times around the monofilament strand 28 before directing the thread 27 through the next hole 17 in the rib member 16. Commercially available forty pound test fishing line is suitable for this purpose. The preferred thread for sewing the mesh fabric reflector panels to each other and to the rib member is any strong, non-stretchable synthetic yarn, such as, for example denier dacron.

Method of Accurizing the Reflector Surface

Figure 8:
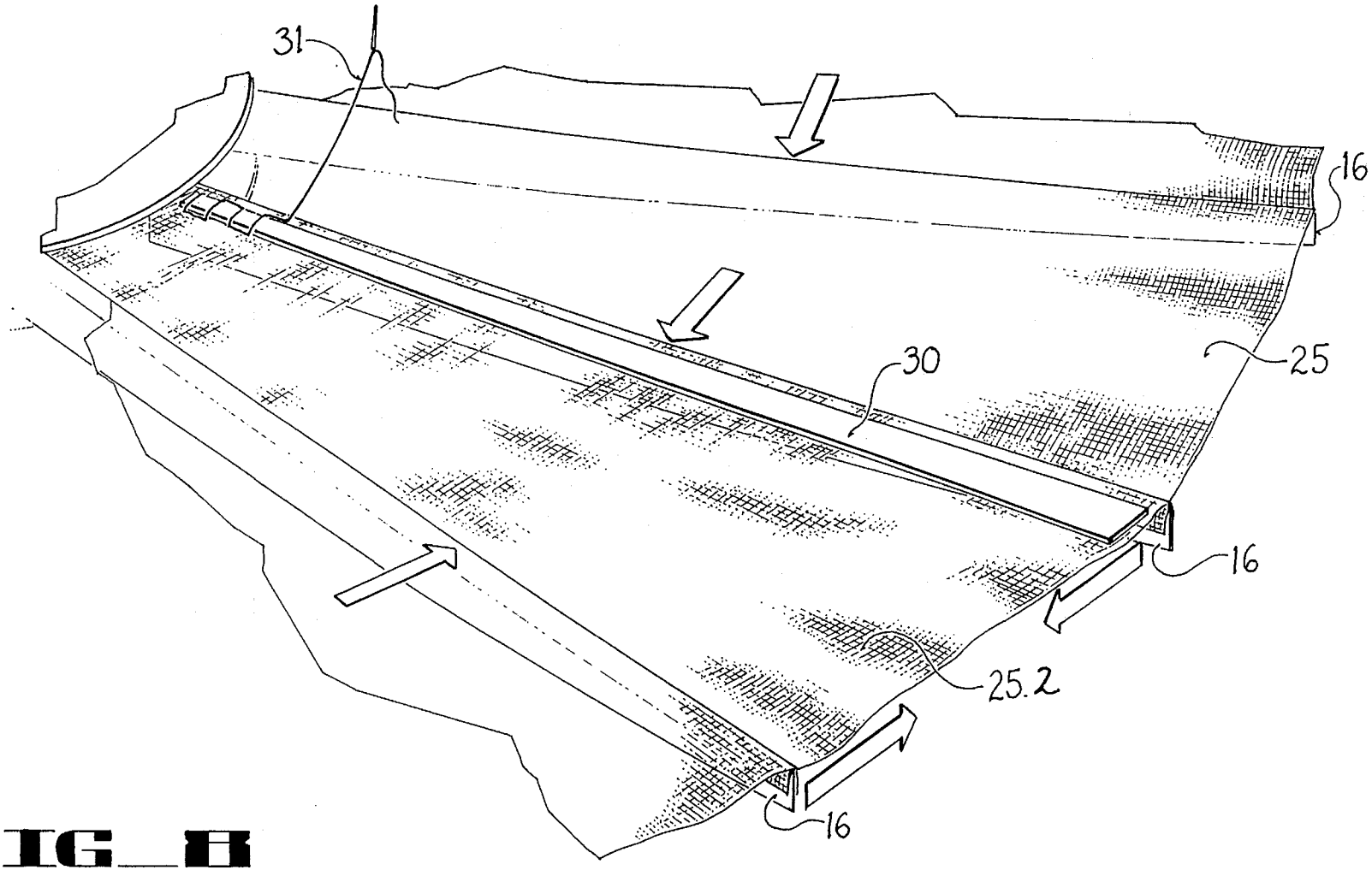
FIG. 8 is an enlarged fragmentary perspective view of three radially extended rib members having gore-shaped mesh fabric reflector panels stretched thereacross and sewn attached thereto and showing a wedge-shaped tool used to make a tuck for accurizing a slack mesh fabric reflector panel.

FIGS. 8–10B illustrate the accurizing method steps of the present invention. FIG. 8 is an enlarged fragmentary perspective view of three radially extended rib members 16 shown having the gore-shaped mesh fabric reflector panels 25 stretched thereacross and sewn attached thereto. Note that once the panels 25 are sewn in place on the rib members 16, there may be certain panels 25 which are slack in places due to tolerance variations in the individual panels and the sewing procedure. It is important to be able to remove the slack in the panels in order to obtain a more accurate reflector surface.

In accordance with the present invention, a lightweight, Mylar wedge-shaped tool 30, preferably on the order of 0.5 mm thickness, is used to form a tuck seam in one or more panels in order to make the panels 25 taut between the rib members 16 as indicated by the arrows in FIG. 8.

FIGS. 9A and 10A show a seam between two slack mesh fabric panels 25 over a rib member 16. In use, the wedge-shaped tool 30 is placed on a slack panel 25 next to a seam and a cord 31 is laced back and forth over the tool 30 along its length in order to put a tuck into the slack panel 25. After lacing is complete, the tool is removed and the two ends of the lacing cord 31 are pulled in opposite directions and tied off in a knot, thereby adding tautness to the panels 25 as indicated by the arrows A and B in FIGS. 9B and 10B, respectively. For best results, the tool 30 should be placed as close as is practical to a seam otherwise the resulting tuck seam will tend to wander.

Mesh Fabric Reflector Panel Construction

FIGS. 11–13B illustrate the novel mesh fabric reflector panel construction of the present invention. FIG. 11 is a close view of the weave pattern 32 for the mesh fabric reflector panels 25. The weave pattern 32 consists of a metal coatable linear polyamide resin strands 33, preferably nylon, and stretch resistant polyester strands 34, preferably denier dacron, interwoven in a conventional "Marquisette style Leno" weave. The preferred reflective metal coating 36 applied to the nylon strands 33 is silver (see FIG. 11A) as it provides the desired reflective characteristics. Nylon, however, is irreversibly stretchable and therefore an all-nylon mesh panel construction would tend to sag and lose its shape over time. Accordingly, the dacron strands 34, being more resistant to stretching but unsuitable for silver coating, are preferably used in the transverse direction (i.e. transverse to the radial direction of the reflector panels) to help maintain the shape of the weave. Creep of the mesh fabric is not a problem in the radial direction of the reflector panel.

The size of the openings 35 in the weave 32 are preferably selected to be large enough to perform well in moderately heavy wind load conditions, yet at the same time be sized small enough to provide good reflectively. With reference to FIGS. 12A–13B, as a general rule of thumb, if the opening of the weave is less than or equal to 1/20 of the wavelength (lambda) of the radio frequency desired to be reflected by the reflector surface, the reflector can reflect greater than about 95% of the incoming radio frequency signals desired to be reflected.

As a specific example, for communications applications up to and including X-Band frequencies, it has been found that a 10 foot diameter reflector having a mesh opening sized in accordance with the above general rule will provide useful performance in 30 mph winds.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

PARTS LIST

1. Tool
2. Metal Gore-Shaped Panels
3. Ribs
4. Mesh fabric reflector panels

5. Magnets
11. Reflector
12. Hub assembly
14. Antenna Feed Assembly
15. Stand off Assembly
16. Rib members
17. Hole
18. Mesh
20. Sheet
21. Templates
22. Mesh fabric material
23. Cut line
24. Sew line
25. Mesh fabric reflector panel
26. Flaps
27. Thread
28. Monofilament
30. Wedge-shaped tool
31. Lacing cord
32. Weave pattern
33. Silver coated nylon strand
34. Dacron strand
35. Weave Opening
36. Silver Coating

What is claimed is:

1. In a deployable reflector of the kind which includes a hub assembly, a plurality of radially extendable ribs members spaced about a periphery of said hub assembly for supporting a plurality of gore-shaped metalized mesh fabric reflector panels stretched thereacross and attached thereto so that a dish-shaped reflective surface is formed when said reflector is deployed, a method for accurizing the mesh fabric reflector panels comprising:

a) placing at least one wedge-shaped tool on a first slack gore-shaped mesh fabric reflector panel adjacent a seam which joins a long side edge of said first gore-shaped mesh fabric reflector panel to an adjacent long side edge of a second gore-shaped mesh fabric reflector panel;

b) lacing a chord through the strands of said first gore-shaped mesh fabric reflector panel and back and forth over said wedge-shaped tool along its length;

c) withdrawing said wedge-shaped tool from said first gore-shaped mesh fabric reflector panel; and d) pulling taut opposite ends of said chord to remove the slack from the reflector panels.

2. A method of accurizing mesh fabric reflector panels as in claim 1 which includes knotting the ends of said chord after pulling taut.

3. A method of accurizing mesh fabric reflector panels as in claim 2 which includes using a second wedge-shaped tool to remove slack from the mesh fabric reflector surface.

4. A method of accurizing mesh fabric reflector panels as in claim 1 wherein:

a) said wedge shaped tool has a first pointed end and a second base end, said base end is wider than said pointed end; and wherein b) said step of placing said at least one wedge-shaped tool on said first slack gore-shaped mesh fabric reflector panel includes orienting said base end adjacent an outer peripheral edge of said first slack gore-shaped mesh fabric reflector panel.

5. A method of accurizing mesh fabric reflector panels as in claim 4 which includes using a second wedge-shaped tool to remove slack from the mesh fabric reflector surface.

6. A method of accurizing mesh fabric reflector panels as in claim 1 which includes-using a second wedge-shaped tool to remove slack from the mesh fabric reflector surface.

* * * * *